US006671382B2

(12) United States Patent
Chen

(10) Patent No.: US 6,671,382 B2
(45) Date of Patent: Dec. 30, 2003

(54) MICROPHONE WITH A ROTATABLE PROTECTIVE SLEEVE

(75) Inventor: Mike Chen, Taipei (TW)

(73) Assignee: Yoga Electronics Co., Ltd., Taipei (TW)

( * ) Notice: Subject to any disclaimer, the term of this patent is extended or adjusted under 35 U.S.C. 154(b) by 124 days.

(21) Appl. No.: 10/102,019

(22) Filed: Mar. 21, 2002

(65) Prior Publication Data

US 2003/0179898 A1 Sep. 25, 2003

(51) Int. Cl.[7] ..... H04R 25/00

(52) U.S. Cl. ..... 381/355; 381/361; 381/362; 381/189

(58) Field of Search ..... 381/355, 359, 381/361, 362, 363, 364, 189

(56) References Cited

U.S. PATENT DOCUMENTS 5,898,789 A * 4/1999 Nichols et al. ..... 381/361
5,988,585 A * 11/1999 Eaton ..... 248/638
6,333,984 B1 * 12/2001 Yang ..... 381/364
6,487,298 B1 * 11/2002 Hacker ..... 381/363

* cited by examiner

*Primary Examiner*—Curtis Kuntz
*Assistant Examiner*—Tuân Duć Nguyêñ
(74) *Attorney, Agent, or Firm*—Morgan Lewis & Bockius LLP

(57) ABSTRACT

A microphone includes a handgrip portion, a protective sleeve, and a connector interconnecting the handgrip portion and the protective sleeve. The connector includes a terminal seat connected to the handgrip portion and formed with a plurality of terminal passages, a first pivot part connected to the terminal seat, and a second pivot part pivoted to the first pivot part and connected to the protective sleeve so as to permit co-rotatation of the protective sleeve and the second pivot part relative to the handgrip portion.

5 Claims, 6 Drawing Sheets

MICROPHONE WITH A ROTATABLE PROTECTIVE SLEEVE

BACKGROUND OF THE INVENTION

1. Field of the Invention

This invention relates to a microphone, more particularly to a microphone with a protective sleeve that is rotatable relative to a handgrip portion of the microphone.

2. Description of the Related Art

FIG. 1 illustrates a conventional microphone including a handgrip portion 98 with a wire-connecting end. A plurality of male terminals 981 are mounted in the wire-connecting end of the handgrip portion 98. A connector 90 includes a terminal seat 91 with a plurality of female terminals 95 mounted therein. The terminal seat 91 is plugged into the wire-connecting end of the handgrip portion 98 in such a manner that the male and female terminals 981, 95 engage each other, respectively. A protective sleeve 93 is connected to one end of the terminal seat 91, which is distal from the handgrip portion 98. A wire line 97 has an end section surrounded by the protective sleeve 93, and includes a plurality of conductive wires 96 extending into the terminal seat 91 for electrical connection to the female terminals 95, respectively. The conventional microphone is disadvantageous in that the wire line 97 is vulnerable to break at a position adjacent to one end 931 of the protective sleeve 93 due to undesired folding of the wire line 97 thereat.

SUMMARY OF THE INVENTION

Therefore, the object of the present invention is to provide a microphone with a connector that has first and second pivot parts pivoted to each other and that is capable of overcoming the aforesaid drawback associated with the prior art.

According to the present invention, a microphone comprises: a handgrip portion that has a wire-connecting end; a connector including a terminal seat, a pivot member, and first and second pivot parts, the terminal seat being formed with a plurality of terminal passages and having two opposite ends, one of which is connected to the wire-connecting end of the handgrip portion, the first pivot part having two opposite ends, one of which is connected to the other one of the opposite ends of the terminal seat, the second pivot part having two opposite ends, one of which is pivoted to the other one of the opposite ends of the first pivot part via the pivot member, the second pivot part cooperating with the first pivot part to confine a wire-channel which is in spatial communication with the terminal passages, the first and second pivot parts being rotatable relative to each other; a protective sleeve connected to the other one of the opposite ends of the second pivot part so as to be co-rotatable with the second pivot part relative to the first pivot part; a plurality of terminals mounted in the terminal passages, respectively; and a wire line having an end section surrounded by the protective sleeve, and a plurality of conductive wires that respectively extend into the terminal passages via the wire-channel and that are electrically connected to the terminals.

BRIEF DESCRIPTION OF THE DRAWINGS

In drawings which illustrate an embodiment of the invention.

DETAILED DESCRIPTION OF THE PREFERRED EMBODIMENT

FIGS. 2 to 6 illustrate a preferred embodiment of a microphone according to this invention.

Figure 1:
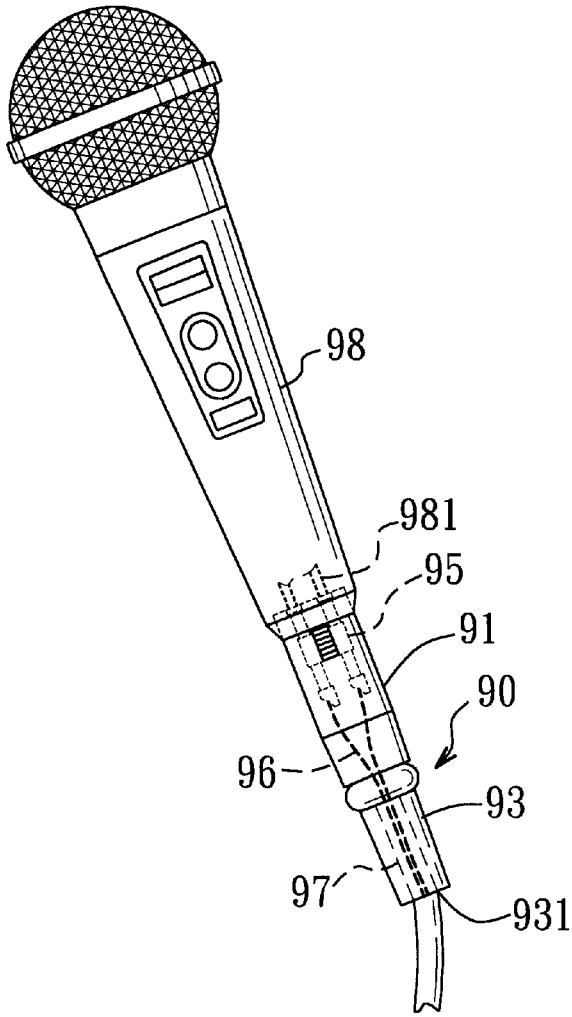
FIG. 1 PRIOR ART
FIG. 1 is a partly schematic side view of a conventional microphone.
Figure 2:
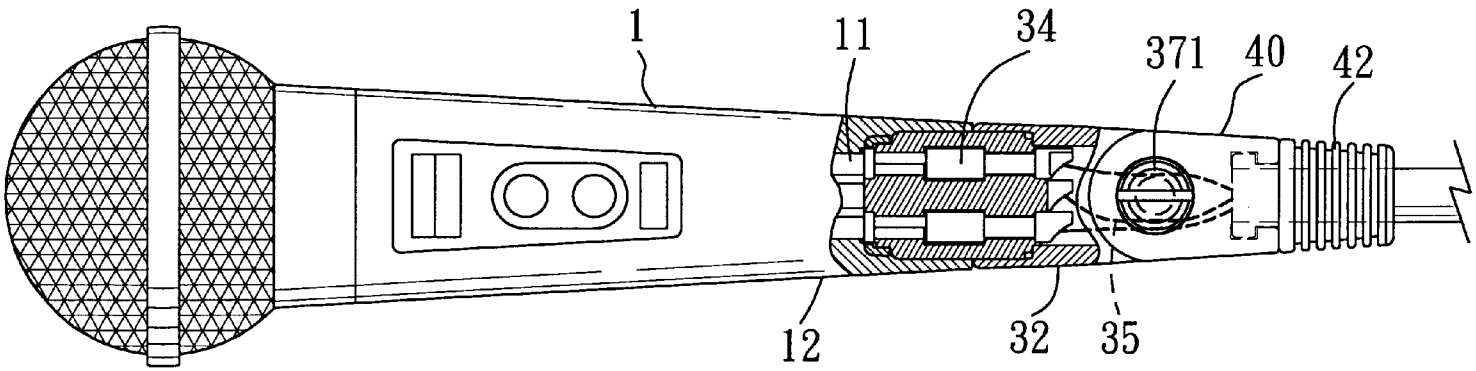
FIG. 2 is a cutaway side view of a microphone embodying this invention.
Figure 3:
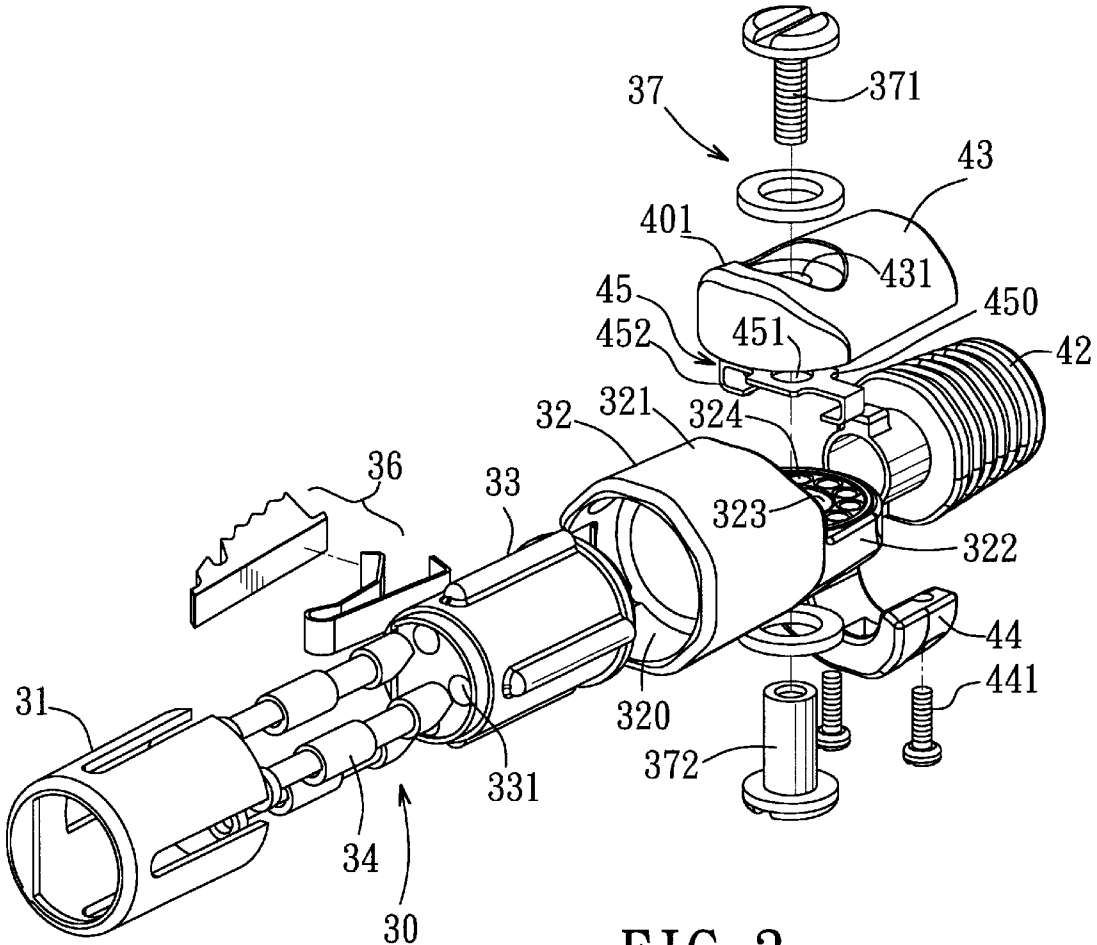
FIG. 3 is an exploded perspective view of a connector of the microphone of FIG. 2, which is viewed from a front side.
Figure 4:
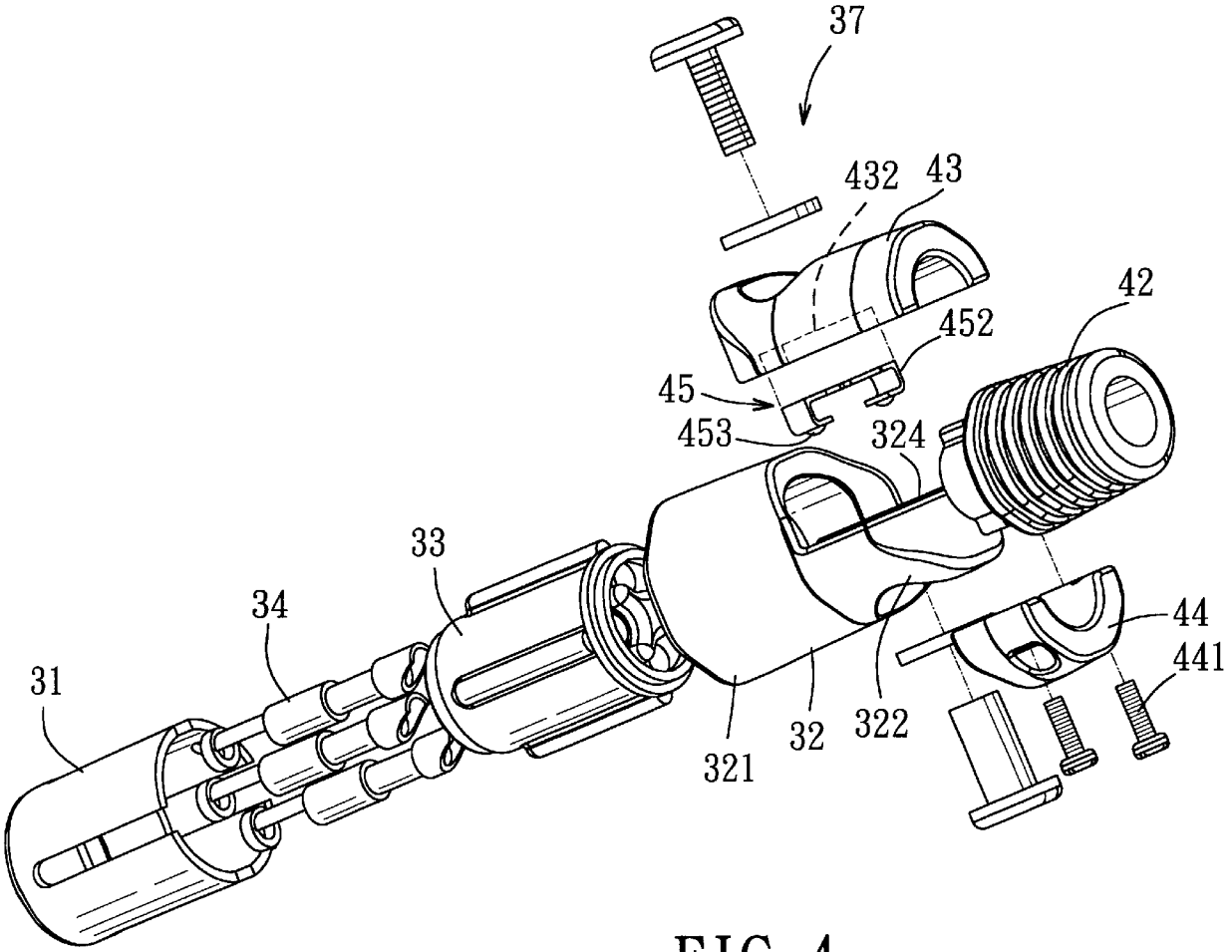
FIG. 4 is another exploded perspective view of the connector of the microphone of FIG. 2, which is viewed from a rear side.
Figure 5:
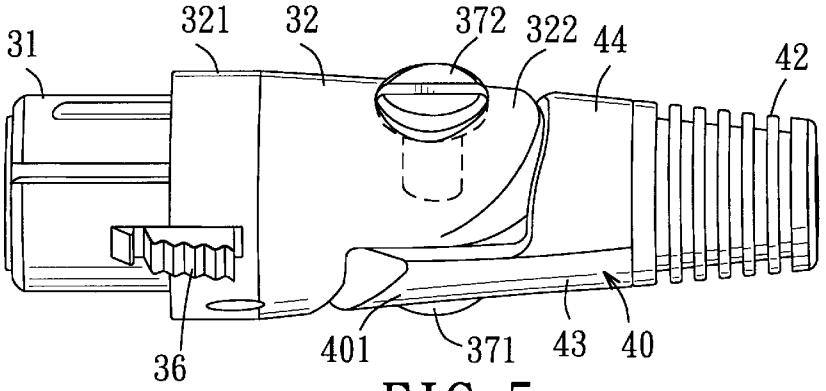
FIG. 5 is a perspective view of the connector of the microphone of FIG. 2.
Figure 6:
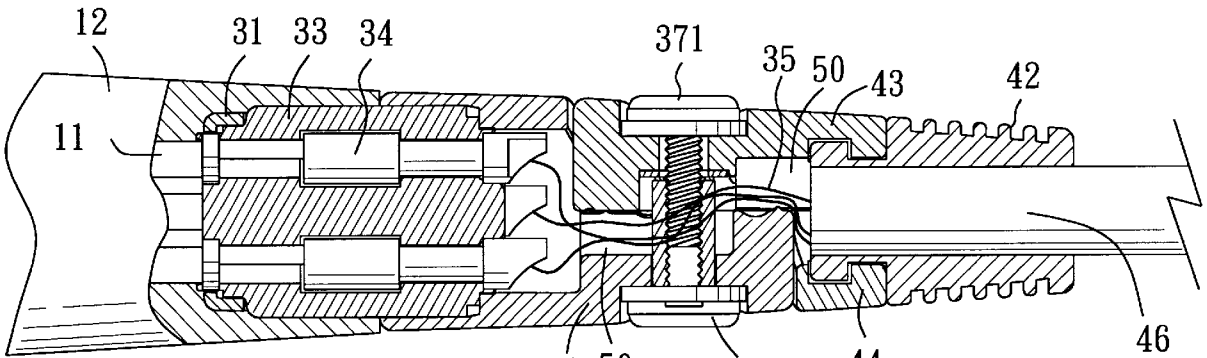
FIG. 6 is a fragmentary partly sectional view of the microphone of FIG. 2.
Figure 7:
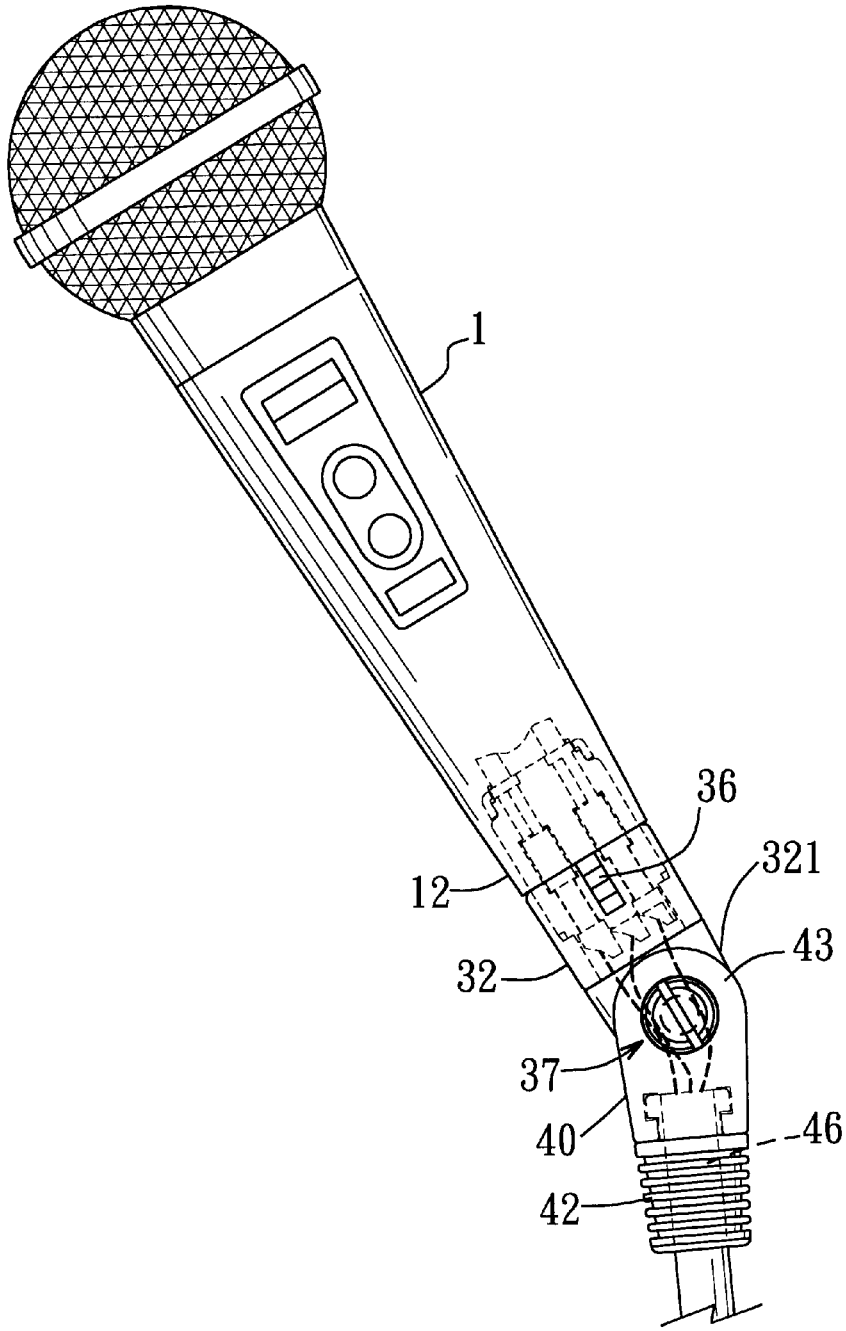
FIG. 7 is a side view to illustrate how a handgrip portion of the microphone of FIG. 2 is turned to an angle relative to a protective sleeve without folding a wire line extending into the microphone of FIG. 2.

The microphone includes: a handgrip portion 1 that has a wire-connecting end 12; a connector including a terminal seat 30 that has one end connected to the wire-connecting end 12 of the handgrip portion 1 and that is formed with a plurality of terminal passages 331, a first pivot part 32 that has one end 321 connected to the other end of the terminal seat 30, and a second pivot part 40 that has one end 401 pivoted to the other end 322 of the first pivot part 32 via a pivot member 37 and that cooperates with the first pivot part 32 to confine a wire-channel 50 which is in spatial communication with the terminal passages 331, the first and second pivot parts 32, 40 being rotatable relative to each other; a protective sleeve 42 connected to the other end of the second pivot part 40 so as to be co-rotatable with the second pivot part 40 relative to the first pivot part 32 (see FIG. 7 in combination with FIG. 2); a plurality of terminals 34 mounted in the terminal passages 331, respectively; and a wire line 46 having an end section surrounded by the protective sleeve 42, and a plurality of conductive wires 35 that respectively extend into the terminal passages 331 via the wire-channel 50 and that are electrically connected to the terminals 34.

The terminal seat 30 includes a generally cylindrical insulator body 33 that is formed with the terminal passages 331 therein, and a cylindrical metal shield 31 sleeved on the insulator body 33. The end 321 of the first pivot part 32 is hollow, and confines a cylindrical hole 320. The insulator body 33 is fittingly secured in the cylindrical hole 320.

The other end 322 of the first pivot part 32 and the end 401 of the second pivot part 40 are generally semi-cylindrical in shape, and are formed with pivot holes 323, 431, respectively. The pivot member 37 includes a headed screw nut 372 that extends into the pivot holes 323, 431 in the other end 322 of the first pivot part 32 and the end 401 of the second pivot part 40, and a headed screw rod 371 that threadedly engages the screw nut 372 in the pivot holes 323, 431 so as to permit relative rotation of the first and second pivot parts 32, 40 about the pivot member 37.

The other end 322 of the first pivot part 32 is formed with a plurality of spaced apart retaining grooves 324 around the pivot hole 323 in the other end 322 of the first pivot part 32. The end 401 of the second pivot part 40 is formed with a retaining recess 432 that spans the pivot hole 431 in the end 401 of the second pivot part 40. The connector further includes a positioning plate 45 that is mounted in the retaining recess 432 and that has an intermediate portion 450 formed with a through-hole 451 for passage of the pivot member 37, and two opposite ends 452 which are formed with retaining tongues 453 projecting into and releasably engaging two of the retaining grooves 324 so as to releasably position the second pivot part 40 at a desired position relative to the first pivot part 32.

The second pivot part 40 has two complementary halves 43, 44 which are secured to each other via screw means 441 so as to facilitate insertion of the protective sleeve 42 in the second pivot part 40.

A plurality of male terminals 11 are mounted in the wire-connecting end 12 of the handgrip portion 1. The terminal seat 30 is fittingly plugged into the wire-connecting end 12 of the handgrip portion 1 so as to electrically connect the male terminals 11 and the terminals 34. A spring-biased fastener 36 is disposed between the wire-connecting end 12 of the handgrip portion 1 and the terminal seat 30 for releasably securing the connector to the handgrip portion 1.

With the use of the connector to interconnect the protective sleeve 42 and the handgrip portion 1 of the microphone, the aforesaid drawback as encountered in the prior art can be eliminated.

With the invention thus explained, it is apparent that various modifications and variations can be made without departing from the spirit of the present invention. It is therefore intended that the invention be limited only as recited in the appended claims.

I claim:

1. A microphone comprising:

a handgrip portion that has a wire-connecting end;

a connector including a terminal seat, a pivot member, and first and second pivot parts, said terminal seat being formed with a plurality of terminal passages and having two opposite ends, one of which is connected to said wire-connecting end of said handgrip portion, said first pivot part having two opposite ends, one of which is connected to the other one of said opposite ends of said terminal seat, said second pivot part having two opposite ends, one of which is pivoted to the other one of said opposite ends of said first pivot part via said pivot member, said second pivot part cooperating with said first pivot part to confine a wire-channel which is in spatial communication with said terminal passages, said first and second pivot parts being rotatable relative to each other;

a protective sleeve connected to the other one of said opposite ends of said second pivot part so as to be co-rotatable with said second pivot part relative to said first pivot part;

a plurality of terminals mounted in said terminal passages, respectively; and a wire line having an end section surrounded by said protective sleeve, and a plurality of conductive wires that respectively extend into said terminal passages via said wire-channel and that are electrically connected to said terminals.

2. The microphone of claim 1, wherein said terminal seat includes a generally cylindrical insulator body that is formed with said terminal passages therein, and a cylindrical metal shield sleeved on said insulator body, said one of said opposite ends of said first pivot part being hollow and confining a cylindrical hole, said insulator body being fittingly secured in said cylindrical hole.

3. The microphone of claim 2, wherein said other one of said opposite ends of said first pivot part and said one of said opposite ends of said second pivot part are generally semi-cylindrical in shape, and are formed with pivot holes, said pivot member including a headed screw nut that extends into said pivot holes in said other one of said opposite ends of said first pivot part and said one of said opposite ends of said second pivot part, and a headed screw rod that threadedly engages said screw nut in said pivot holes so as to permit relative rotation of said first and second pivot parts about said pivot member.

4. The microphone of claim 3, wherein said other one of said opposite ends of said first pivot part is formed with a plurality of spaced apart retaining grooves around said pivot hole in said other one of said opposite ends of said first pivot part, said one of said opposite ends of said second pivot part being formed with a retaining recess that spans said pivot hole in said one of said opposite ends of said second pivot part, said connector further including a positioning plate that is mounted in said retaining recess and that has an intermediate portion formed with a through-hole for passage of said pivot member, and two opposite ends which are formed with retaining tongues projecting into and releasably engaging two of said retaining grooves so as to releasably position said second pivot part at a desired position relative to said first pivot part.

5. A connector for a microphone having a handgrip portion, a protective sleeve connected to the handgrip portion via said connector, and a wire line having an end section surrounded by the protective sleeve and a plurality of conductive wires, the handgrip portion having a wire-connecting end, said connector comprising:

a terminal seat that is formed with a plurality of terminal passages and that has two opposite ends, one of which is adapted to be connected to the wire-connecting end of the handgrip portion;

a pivot member;

a first pivot part that has two opposite ends, one of which is connected to the other one of said opposite ends of said terminal seat;

a second pivot part that has two opposite ends, one of which is pivoted to the other one of said opposite ends of said first pivot part via said pivot member, said second pivot part cooperating with said first pivot part to confine a wire-channel which is in spatial communication with said terminal passages, said first and second pivot parts being rotatable relative to each other, the other one of said opposite ends of said second pivot part being adapted to be connected to the protective sleeve so as to permit co-rotation of the protective sleeve and said second pivot part relative to said first pivot part; and a plurality of terminals mounted in said terminal passages, respectively, and adapted to be electrically and respectively connected to the conductive wires which extend from the protective sleeve into said terminal passages via said wire-channel.

* * * * *